US006776005B2

(12) United States Patent
Fuentes et al.

(10) Patent No.: US 6,776,005 B2
(45) Date of Patent: Aug. 17, 2004

(54) AIR SEPARATION METHOD AND PLANT

(75) Inventors: François Fuentes, Le Vesinet (FR); Richard Dubettier, La Varenne (FR)

(73) Assignee: L'Air Liquide - Societe Anonyme a Directoire et Conseil de Surveillance pour l'Etude et l'Exploitation des Procedes Georges Claude, Paris Cedex (FR)

( * ) Notice: Subject to any disclaimer, the term of this patent is extended or adjusted under 35 U.S.C. 154(b) by 88 days.

(21) Appl. No.: 10/169,354

(22) PCT Filed: Dec. 28, 2000

(86) PCT No.: PCT/FR00/03706

§ 371 (c)(1),
(2), (4) Date: Nov. 15, 2002

(87) PCT Pub. No.: WO01/49394

PCT Pub. Date: Jul. 12, 2001

(65) Prior Publication Data

US 2003/0140653 A1 Jul. 31, 2003

(30) Foreign Application Priority Data

Dec. 30, 1999 (FR) ..... 99/16751

(51) Int. Cl.[7] ..... F25J 3/00
(52) U.S. Cl. ..... 62/651

(58) Field of Search ..... 62/617, 640, 643, 62/651

(56) References Cited

U.S. PATENT DOCUMENTS

| | | | | |
|---|---|---|---|---|
| 3,950,957 A | | 4/1976 | Zakon | |
| 4,557,735 A | | 12/1985 | Pike | |
| 4,729,217 A | | 3/1988 | Kehlhofer | |
| 4,883,516 A | * | 11/1989 | Layland et al. | 62/22 |
| 4,968,337 A | * | 11/1990 | Layland et al. | 62/24 |
| 5,681,158 A | | 10/1997 | Knapp | |
| 5,711,166 A | * | 1/1998 | Mehta et al. | 62/650 |
| 5,722,259 A | * | 3/1998 | Sorensen et al. | 62/646 |

FOREIGN PATENT DOCUMENTS

| | | |
|---|---|---|
| DE | 25 53 700 | 6/1977 |
| EP | 0 959 314 | 11/1999 |
| FR | 2 120 034 | 8/1972 |

* cited by examiner

*Primary Examiner*—Denise L. Esquivel
*Assistant Examiner*—Malik N. Drake
(74) *Attorney, Agent, or Firm*—Young & Thompson

(57) ABSTRACT

The pressurized waste nitrogen (11) from a column of an air separation unit (10) is sent, optionally after being compressed, to a combustion chamber (15) where it is heated, to a turbine (17) in which it is expanded and again to the combustion chamber (15) where it is mixed with the flue gases in order to give up waste heat thereto.

17 Claims, 1 Drawing Sheet

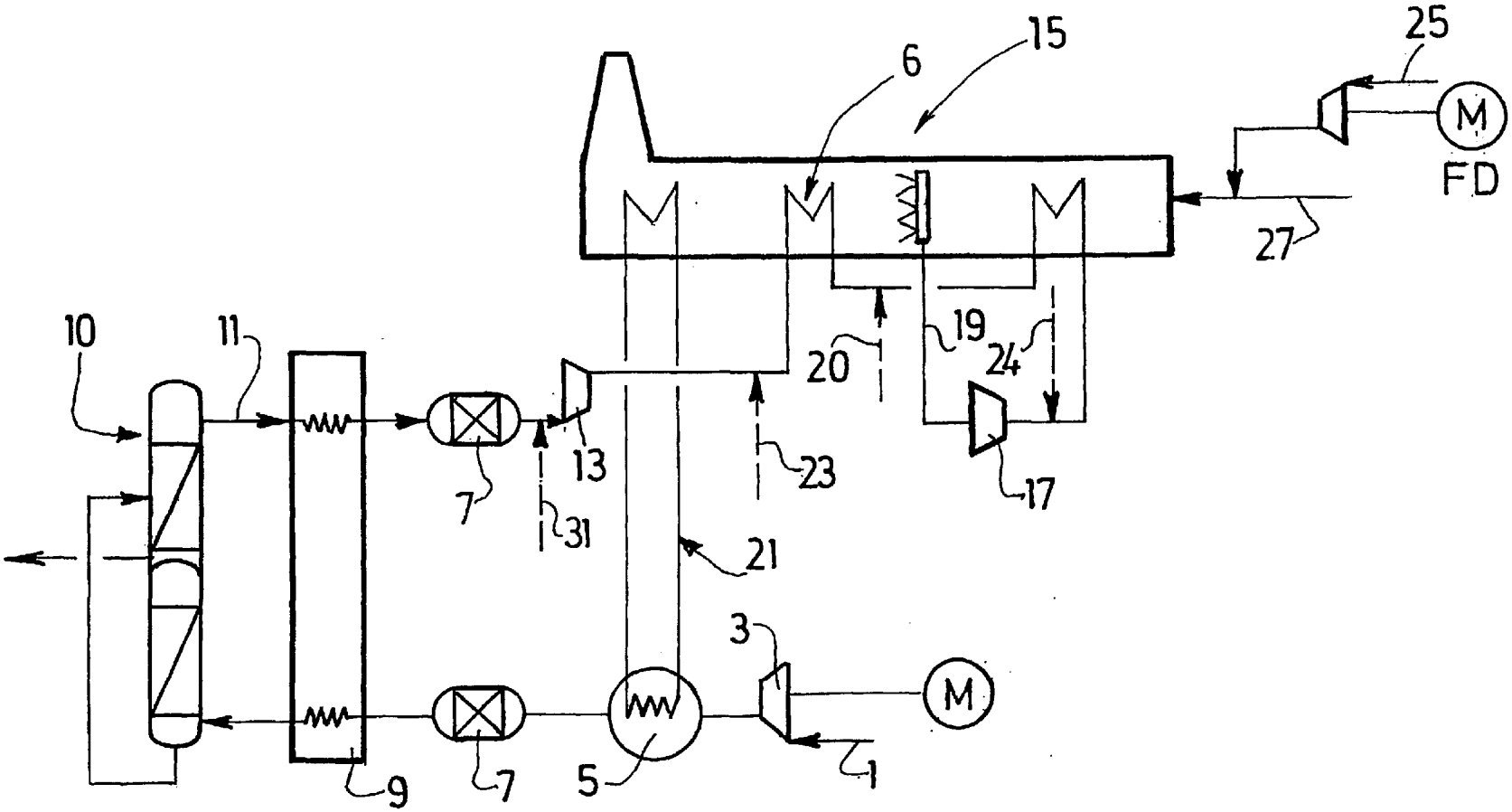
M
FD
25
27
15
6
24
17
19
20
23
21
M
1
3
5
13
31
7
7
9
11
10

AIR SEPARATION METHOD AND PLANT

CROSS REFERENCE TO RELATED APPLICATION

This is the 35 USC 371 national stage of international application PCT/FR00/03706 filed on Dec. 28, 2000, which designated the United States of America.

FIELD OF THE INVENTION

The present invention relates to an air separation process and an air separation plant. In particular, it relates to a process which produces a nitrogen-enriched stream at a pressure of at least 2 bar which is expanded in a turbine.

In particular, it relates to an air separation process and an air separation plant which are integrated with a combustion chamber.

BACKGROUND OF THE INVENTION

Cryogenic air separation units conventionally operate with two distillation columns, one called a medium-pressure column, operating at about 4 to 10 bar, and one called a low-pressure column, operating at between 1 and 3 bar.

An increase in these pressures, although making the distillation more difficult, would be beneficial, as it would allow the volume of the equipment (and therefore their costs) to be reduced and would allow energy irreversibilities due to head losses in the various circuits to be reduced.

However, it is quite rare to be able to increase these pressures, as it is necessary to utilize for economic purposes the energy contained in the waste fluids not conventionally "commercially utilizable" because of their purity levels.

The conventional solutions are, for example:

- to reinject this waste into gas turbines (in particular the case of IGCC plants);
- to subject this fluid to cold expansion in a turbine so as to produce liquid;
- high-temperature expansion in a turbine (as described in patent application EP-A-0 402 045). DE-A-2 553 700 describes an air separation unit which produces a nitrogen-enriched gas stream. After a compression step, the gas stream is heated by indirect heat exchange inside a combustion chamber before being expanded in a turbine. The gas expanded in the turbine serves to preheat the compressed gas to be sent to the combustion chamber.

U.S. Pat. No. 3,950,957 discloses an air separation unit in which the nitrogen produced is expanded after being heated up in a boiler. The remaining heat in the expanded nitrogen is transferred to the boiler by indirect heat exchange.

In U.S. Pat. No. 5,459,994, a nitrogen stream is expanded in a turbine, mixed with air, compressed and sent to a combustion chamber.

In U.S. Pat. No. 4,729,217, after having been mixed with the fuel, the nitrogen is expanded in a turbine and sent to a combustion chamber.

U.S. Pat. No. 4,557,735 describes the case in which the nitrogen is expanded at a cryogenic temperature, compressed, mixed with air and sent to a combustion chamber.

EP-A-0 959 314 relates to a process for expanding a mixture of air and waste nitrogen, in which the mixture is sent to a combustion chamber.

The proposed scheme corresponds to the waste nitrogen undergoing expansion in a turbine at high temperature in an innovative and effective manner.

SUMMARY OF THE INVENTION

It is one object of the invention to provide an air separation process in which a stream of compressed and purified air is separated in an air separation unit in order to produce a nitrogen-enriched gas stream at between 2 and 7 bar, the nitrogen-enriched gas stream is expanded in a turbine and the expanded gas stream is sent to a convection region located downstream of a combustion chamber, characterized in that the gas stream is expanded without having been mixed with a stream of fuel and it is not mixed with a stream of air after its expansion.

Optionally:

- the nitrogen-enriched gas stream is preheated by indirect heat exchange with the gases inside the combustion chamber before being expanded;
- the temperature at which the nitrogen enters the turbine is at least 700° C.;
- the nitrogen-enriched stream is preheated by indirect exchange in the combustion chamber in one step up to an intermediate temperature and then in a second step up to the turbine entry temperature and the expanded gas sent into the combustion chamber gives up heat to the gas stream to be expanded during the first preheating step;
- the nitrogen-enriched gas stream is compressed to a pressure of between 5 and 20 bar before being expanded;
- the air is cooled after its compression by means of an absorption refrigerating unit and pressurized water intended for the refrigerating unit is heated by the gases from the combustion chamber to which gases the nitrogen-enriched gas stream is added;
- the air is purified in a purifying means before being sent to the separation unit, the purifying means is regenerated by a nitrogen-enriched gas stream and at least one portion of the stream that has served for the regeneration is sent to the expansion turbine;
- the nitrogen-enriched stream is withdrawn from a single column or from the medium-pressure column and/or the low-pressure column of a double column or from the high-pressure column and/or the intermediate-pressure column and/or the low-pressure column of a triple column;
- the nitrogen-enriched stream is mixed with a nitrogen-enriched gas coming from an external source before being expanded in the turbine;
- the nitrogen-enriched stream contains at least 50 mol % nitrogen and between 0.5 and 10 mol % oxygen;
- the column from which the nitrogen-enriched stream comes operates between substantially 2 and 7 bar;
- the nitrogen-enriched stream is not mixed with air before being expanded in the turbine;
- a nitrogen-enriched stream, preferably containing at least 50 mol % nitrogen, coming from an external source, is mixed with the nitrogen-enriched stream coming from the air separation unit, upstream of the expansion turbine.

Another object of the invention is to provide an air separation plant comprising:

i) an air separation unit operating by cryogenic distillation, ii) a combustion chamber followed by a heat-recovery region comprising a convection region, (iii)an expansion turbine, (iv) means for sending air to the air separation unit operating by cryogenic distillation, (v) means for withdrawing a nitrogen-enriched gas from the air separation unit operating by cryogenic distillation, (vi) means for sending the nitrogen-enriched gas to the expansion turbine and (vii) means for sending the nitrogen-enriched gas from the expansion turbine to the convection region located downstream of the combustion chamber characterized in that it comprises neither means for mixing air with the nitrogen-enriched gas downstream of the turbine and upstream of the combustion chamber nor means for mixing fuel with the nitrogen-enriched gas before its expansion.

Optionally, the plant may comprise:

means for preheating the nitrogen-enriched gas stream by indirect heat exchange with the gases inside the combustion chamber upstream of the expansion turbine;

means for preheating the nitrogen-enriched stream by indirect exchange in the combustion chamber in one step up to an intermediate temperature and then in a second step up to the turbine entry temperature;

a refrigerating unit in which the air is cooled after it has been compressed, a pressurized-water circuit intended for the refrigerating unit and a means for heating the pressurized-water circuit by the gases from the combustion chamber, to which gases the nitrogen-enriched gas stream has been added;

a purifying means in which the air is purified before being sent to the separation unit, the purifying means being regenerated by a nitrogen-enriched gas stream, and means for sending at least a portion of the stream that has served for the regeneration to the expansion turbine;

means for withdrawing the nitrogen-enriched stream from a single column or from the medium-pressure column and/or low-pressure column of a double column or from the high-pressure column and/or the intermediate-pressure column and/or the low-pressure column of a triple column; and means for mixing a nitrogen-enriched waste gas (preferably containing at least 50 mol % nitrogen) coming from an external source with the nitrogen-enriched gas to be expanded.

BRIEF DESCRIPTION OF THE DRAWING

The invention will now be described with reference to the FIGURE, which is a diagram of a plant according to the invention.

DETAILED DESCRIPTION OF THE INVENTION

A stream of air 1 is compressed in a compressor 3, cooled by means of a refrigerating unit 5 and purified in absorbent beds 7.

Next, the air is cooled in the main exchanger 9 before being sent to the medium-pressure column of a double column.

Rich liquid is sent from the medium-pressure column to the low-pressure column and an oxygen-rich gas is withdrawn from the low-pressure column. This oxygen-rich gas may possibly be sent to an oxygen-consuming unit which produces a fuel 27 for a combustion chamber 15. This unit may be a blast furnace, a steel production unit or a unit for producing other metals, etc.

Impure gaseous nitrogen 11 containing less than one to a few mol % oxygen, available at room temperature and at moderate pressure (2 to 7 bar) at the top of the low-pressure column of the double column with a flow rate of 50000 $Nm^3/h$ to 500000 $Nm^3/h$ is compressed in a compressor 13 to a pressure of about 10 to 20 bar, after having regenerated the adsorbent bed 7. It contains the impurities trapped by the latter.

This fluid, then at a temperature of about 90 to 150° C. (as there is no final coolant downstream of the compressor 13) is heated, in two separate steps A, B, in a combustion chamber 15 up to a temperature of about 700 to 800° C.

The combustion chamber 15 is fed with fuel 27 and with compressed air 25 or another source of oxygen. The compressed air may come from an FD (forced draft) fan.

The combustion chamber possibly consists of a furnace having at least one burner.

The heated waste nitrogen is then expanded up to a pressure close to atmospheric pressure in an expansion turbine 17 coupled to an electrical generator and/or compression means of the air separation unit.

The expanded fluid 19, at a temperature of 350 to 450° C., is then mixed with the flue gases of the combustion chamber at a substantially identical level, intermediate between the two heating steps A, B mentioned above, so as to minimize the irreversibilities.

The waste heat from the flue gases to which the waste nitrogen is added is used to heat up pressurized water 21 (to approximately 110–130° C.) which is needed to operate the absorption refrigerating unit 5 (using lithium bromide or equivalent) intended to cool the air entering the air separation unit.

The overall energy budget is particularly beneficial and allows low-grade energy to be economically utilized.

There is a match between the requirements of the refrigerating unit of the air separation unit and the heat available from the flue gases in the combustion chamber at the temperature level indicated.

This scheme allows the energy contained in the waste nitrogen to be economically utilized without having the expensive circuits needed for the production of boiler water.

Because of the injection of waste nitrogen, the steam content in the flue gases is relatively low and allows the energy to be recovered at low temperature levels without any risk of condensation (and therefore of corrosion) in the stack of the combustion chamber.

At least one portion of the waste nitrogen, as well as the heat available from the system (waste compression or heat from the flue gases) may be used to regenerate the adsorbent beds of the air separation unit before being compressed, heated in the combustion chamber and sent to the turbine.

Of course, the double column in the FIGURE may be replaced with a triple column such as that in EP-A-0 538 118.

The nitrogen to be expanded may be extracted from the column operating at the lowest pressure and/or from the column operating at the highest pressure and/or from the column operating at intermediate pressure (in the case in which the air separation unit is a triple column).

The combustion chamber may be oversized so as to be able also to produce steam, operating as a boiler.

A portion of the waste nitrogen may be removed at various points so as to serve as stage gas and/or cooling gas for the blades or the rotor of the nitrogen expansion turbine or of another turbine.

A portion of the waste nitrogen may be injected into the burners of the combustion chamber in order to control the $NO_x$ level.

The scheme may obviously be designed without a nitrogen compressor, especially if the low-pressure column operates at a pressure above 1.4 bar.

In many refineries, there are units of the FCC (fluidized catalytic cracking) type in which the regeneration gas is available at about 700° C. and 3 to 4 bar. This gas is generally expanded in a turbine, then the heat is recovered.

It is often found that FCC plants are modest in size and therefore the investment in a turbine is not economically justifiable. We would therefore be able to propose to expand this gas at the same time after having mixed it with the nitrogen.

It is also possible to expand other waste gases having a high nitrogen content (above 50 mol %) with the nitrogen coming from the ASU.

As a variant, this gas or these gases may be mixed with the nitrogen at the points indicated by the dotted arrows 20, 23, 24, 31 (before or after the first heating step, just upstream of the turbine or upstream of the nitrogen compressor) depending on its temperature and its pressure.

Application 1: FCC Units or Fluidized-bed Catalytic Cracking Units

| Example of gases: | |
|---|---|
| $N_2$ | 72.5% |
| Ar | 1% |
| $CO_2$ | 14% |
| $O_2$ | 1% |
| $H_2O$ | 11.5% |

Traces of CO, $NO_x$ and $SO_2$.

The flow rate is of the same order of magnitude as that of the waste nitrogen (i.e. 50000 $Nm^3/h$ to 500000 $Nm^3/h$). The pressure is typically from 2 to 6 bar abs.

NB: the regeneration of the FCC may be improved by enrichment of the air. In this case, the oxygen intended for the enrichment may come from the ASU which delivers the nitrogen.

Second Application Case: Nitric Acid Units

In these units, a gas containing at least 50 mol % nitrogen is produced at the top of an absorption column fed with air.

Other fuller integrations are also possible:

either at the oxygen injection point in order to produce synthesis gas for manufacturing ammonia, which is then used to make nitric acid;

or by enrichment of the air intended for the actual nitric acid plant (applied in general during debottlenecking). A low flow rate is involved here.

The pressure is typically from 2 to 10 bar abs and the flow rate from 20000 $Nm^3/h$ to 200000 $Nm^3/h$.

What is claimed is:

1. An air separation process, which comprises:

seperating a stream of compressed and purified air in an air separation unit in order to produce a nitrogen-enriched gas stream at between 2 and 7 bar;

expanding the nitrogen-enriched gas stream in a turbine to obtain an expanded gas stream; and sending the expanded gas stream to a convection region located downstream of a combustion chamber, wherein the gas stream is expanded without having been mixed with a stream of fuel and the expanded gas stream is not mixed with a stream of air.

2. The process according to claim 1, wherein the nitrogen-enriched gas stream is preheated by indirect heat exchange with the gases inside the convection region of the combustion chamber before being expanded.

3. The process according to claim 2, wherein the nitrogen enters the turbine at a temperature of at least 700° C.

4. The process according to claim 2, wherein the nitrogen-enriched gas stream is preheated by indirect exchange in the combustion chamber in one step up to an intermediate temperature, and the expanded gas sent into the combustion chamber gives up heat to the gas stream to be expanded during the first preheating step.

5. The process according to claim 1, wherein the nitrogen-enriched gas stream is compressed to a pressure of between 5 and 20 bar before being expanded.

6. The process according to claim 1, wherein the air is cooled after compression by a refrigerating unit, and pressurized water intended for the refrigerating unit is heated by the gases from the combustion chamber to which gases the nitrogen-enriched gas stream is added.

7. The process according to claim 1, wherein the air is purified in a purifying means before being sent to the separation unit, the purifying means is regenerated by a nitrogen-enriched gas stream, and at least one portion of the stream that has served for the regeneration is sent to the expansion turbine.

8. The process according to claim 1, wherein the nitrogen-enriched gas stream is withdrawn from a single column, or from at least one of the medium-pressure column and the low-pressure column of a double column, or from at least one of the high-pressure column, the intermediate-pressure column and the low pressure column of a triple column.

9. The process according to claim 1, wherein the nitrogen-enriched gas stream contains at least 50 mol % nitrogen and between 0.5 and 10 mol % oxygen.

10. The process according to claim 1, wherein a nitrogen-enriched stream containing at least 50 mol % nitrogen, coming from an external source, is mixed the nitrogen-enriched gas stream coming from the air separation unit, upstream of the expansion turbine.

11. An air separation plant comprising:

i) an air separation unit operating by cryogenic distillation;

ii) a combustion chamber followed by a heat recovery region comprising at least one convection region;

iii) an expansion turbine;

iv) means for sending air to the air separation unit;

v) means for withdrawing a nitrogen-enriched gas stream from the air separation unit;

vi) means for sending the nitrogen-enriched gas stream to the expansion turbine; and vii) means for sending the nitrogen-enriched gas stream from the expansion turbine to the convection region located downstream of the combustion chamber characterized in that it comprises neither means for mixing air with the nitrogen-enriched gas downstream of the turbine and upstream of the combustion chamber nor means for mixing fuel with the nitrogen-enriched gas stream before its explanation.

12. The plant according to claim 11, comprising means for preheating the nitrogen-enriched gas stream by indirect heat exchange with the gases inside the combustion chamber upstream of the expansion turbine.

13. The plant according to claim 11, comprising means for preheating the nitrogen-enriched stream by indirect exchange in the combustion chamber in one step up to an intermediate temperature and then in a second step up to the turbine entry temperature.

14. The plant according to claim 11, comprising a refrigerating unit in which the air is cooled after it has been compressed, a pressurized-water circuit intended for the refrigerating unit and a means for heating the pressurized-water circuit by the gases from the combustion chamber, to which gases the nitrogen-enriched gas stream has been added.

15. The plant according to claim 11, comprising a purifying means in which the air is purified before being sent to the separation unit; the purifying means being regenerated by a nitrogen-enriched gas stream; and means for sending at least a portion of the stream that has served for the regeneration to the expansion turbine.

16. The plant according to claim 11, comprising means for withdrawing the nitrogen-enriched gas stream from a single column, or from at least one of the medium-pressure column and the low-pressure column of a double column, or from at least one of the high-pressure column, the intermediate-pressure column and the low-pressure column of a triple column or a mixing column.

17. The plant according to claim 11, comprising means for mixing a nitrogen-enriched waste gas containing at least 50 mol % nitrogen, coming from an external source with the nitrogen-enriched gas stream to be expanded.

* * * * *